US012150528B1

(12) United States Patent
Yen

(10) Patent No.: US 12,150,528 B1
(45) Date of Patent: Nov. 26, 2024

(54) DEVICE STRUNG WITH BEADS AND CARRYING METHOD FOR BEADS

(71) Applicant: Tienyung Yen, Taiwan (CN)

(72) Inventor: Tienyung Yen, Taiwan (CN)

( * ) Notice: Subject to any disclaimer, the term of this patent is extended or adjusted under 35 U.S.C. 154(b) by 0 days.

(21) Appl. No.: 18/658,742

(22) Filed: May 8, 2024

(51) Int. Cl.
*A44C 27/00* (2006.01)

(52) U.S. Cl.
CPC ..... *A44C 27/00* (2013.01)

(58) Field of Classification Search
CPC .. A45F 5/00; A45F 5/10; A44C 27/00; D04D 1/04
USPC ..... 294/5.5, 143, 158; 224/255, 270
See application file for complete search history.

(56) References Cited

U.S. PATENT DOCUMENTS 3,228,555 A * 1/1966 Pinto ..... A63F 11/0002 221/199
4,283,082 A * 8/1981 Tracy ..... B25B 33/00 294/93
4,307,908 A * 12/1981 Donaldson ..... A45D 8/34 132/200
5,664,707 A * 9/1997 Spector ..... D04D 1/04 29/241
5,855,403 A * 1/1999 Harper ..... A45F 5/1026 294/166
5,882,056 A * 3/1999 Broadwell ..... A63B 71/00 294/158
5,967,151 A * 10/1999 Villani ..... F16G 11/101 132/270
6,279,797 B1 * 8/2001 Snyder ..... B65H 75/366 224/268
7,132,048 B2 * 11/2006 Hagashihara ..... B01D 29/96 294/90

* cited by examiner

*Primary Examiner* — Dean J Kramer
(74) *Attorney, Agent, or Firm* — Hawaii Patent Services; Nathaniel K. Fedde; Kenton N. Fedde

(57) ABSTRACT

A device strung with beads, comprising a long rod and a plurality of beads, the long rod comprises anti-drop end and grip end, the grip end is integrally formed on the long rod, the anti-drop end is located at an end of the long rod and is away from the grip end; a portion, located between the grip end and the anti-drop end, of the long rod is configured as a carrying portion; the beads are strung on the carrying portion, a hole is formed in the middle of each of the beads, the long rod penetrates through the holes; the anti-drop end comprises first bent rod and second bent rod located on an inner side of the bent rod, the first bent rod and the second bent rod are formed integrally; the first bent rod is integrally formed at the end of the long rod to form bent portion.

18 Claims, 8 Drawing Sheets

DEVICE STRUNG WITH BEADS AND CARRYING METHOD FOR BEADS

TECHNICAL FIELD

The invention relates to the technical field of bead stringing equipment, in particular to a device strung with beads and a carrying method for beads.

BACKGROUND

At present, the increasing emphasis of people on personalization and uniqueness leads to a prevalence of various DIY bead bracelets that are designed and made according to personal preference, and these DIY bead bracelets not only can reflect people's personal style and taste, but also can bring pleasure and a sense of achievement to people.

Nowadays, beads on the market are usually loaded and transported in boxes in a scattered state, thus being prone to dropping and going missing. Optionally, beads are strung on strings to be transported. Although such a method can solve the problem of scattering of beads during the transportation process, firm knots, which are difficult to untie, need to be tied at the ends of the strings strung with beads, and the strings may be intertwined and knotted, making it difficult to unstring the beads from the strings.

SUMMARY

An objective of the invention is to provide a device strung with beads and a carrying method for beads to solve the problem that beads are inconvenient to carry and unstring proposed in the description of related art.

To fulfill the above objective, the invention adopts the following technical solution:

A device strung with beads, comprising a long rod and a plurality of beads; and the long rod comprises at least one anti-drop end and at least one grip end, the grip end is integrally formed on the long rod, and the anti-drop end is located at an end of the long rod and is away from the grip end; and a portion, located between the grip end and the anti-drop end, of the long rod is configured as a carrying portion, the beads are strung on the carrying portion, a hole is formed in a middle of each of the beads, and the long rod penetrates through the holes.

A carrying method for beads uses a device strung with beads, wherein the device comprises a long rod and at least one bead, the long rod comprises at least one anti-drop end and at least one grip end, the grip end is integrally formed on the long rod, the anti-drop end is located at an end of the long rod, and a portion, between the grip end and the anti-drop end, of the long rod is configured as a carrying portion;

the method comprises:

Step 1, aligning a hole of the bead with the anti-drop end of the long rod; and

Step 2, stringing the bead between the long rod and a first bent rod, and then pushing the bead to slide toward the grip end; and Step 3, sliding the bead through the anti-drop end and stringing the bead on the carrying portion; and Step 4, stacking and stringing multiple beads on the carrying portion of the long rod according to Step 1 to Step 3; and Step 5, when the beads need to be transported or carried, transporting or carrying the beads by holding a fixed silicone block to realize, or by hanging or clamping the device strung with the beads at a desired position; and Step 6, when the beads need to be unstrung, gripping the beads and pushing the beads to move towards the anti-drop end and then slide out of the anti-drop end to be unstrung from the long rod.

Compared with the prior art, the invention fulfills the following beneficial effects:

The carrying portion is arranged on the long rod, and beads can be strung on the carrying portion; after being strung on the carrying portion, the beads will be limited on the long rod by the anti-drop end 2, such that the beads can be stored and carried easily and will not be scattered, and intertwining and knotting of bead strings are avoided.

The grip end and the fixed silicone block are arranged, and after beads are strung on the long rod, users can grip and carry the collected beads easily and quickly by holding the fixed silicon block with fingers.

The suspension opening is arranged, and when beads are transported or carried, a string can penetrate through the suspension opening to tie the device strung with the beads at a desired position, or the suspension opening can be hung on a hook, such that the beads can be transported or carried more easily.

Through the cooperation of the bent portion and the protruding portion of the anti-drop end, the anti-drop end will be compressed to allow beads to slide in or out of the long rod to be strung or unstrung; and when the beads are carried or are not unstrung, the bent portion and the protruding portion rebound elastically, and the protruding portion is higher than the holes of the beads, such that the beads are limited to be prevented from dropping. In this way, the beads can be stung and unstrung easily and quickly.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the detailed description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

Figure 1:
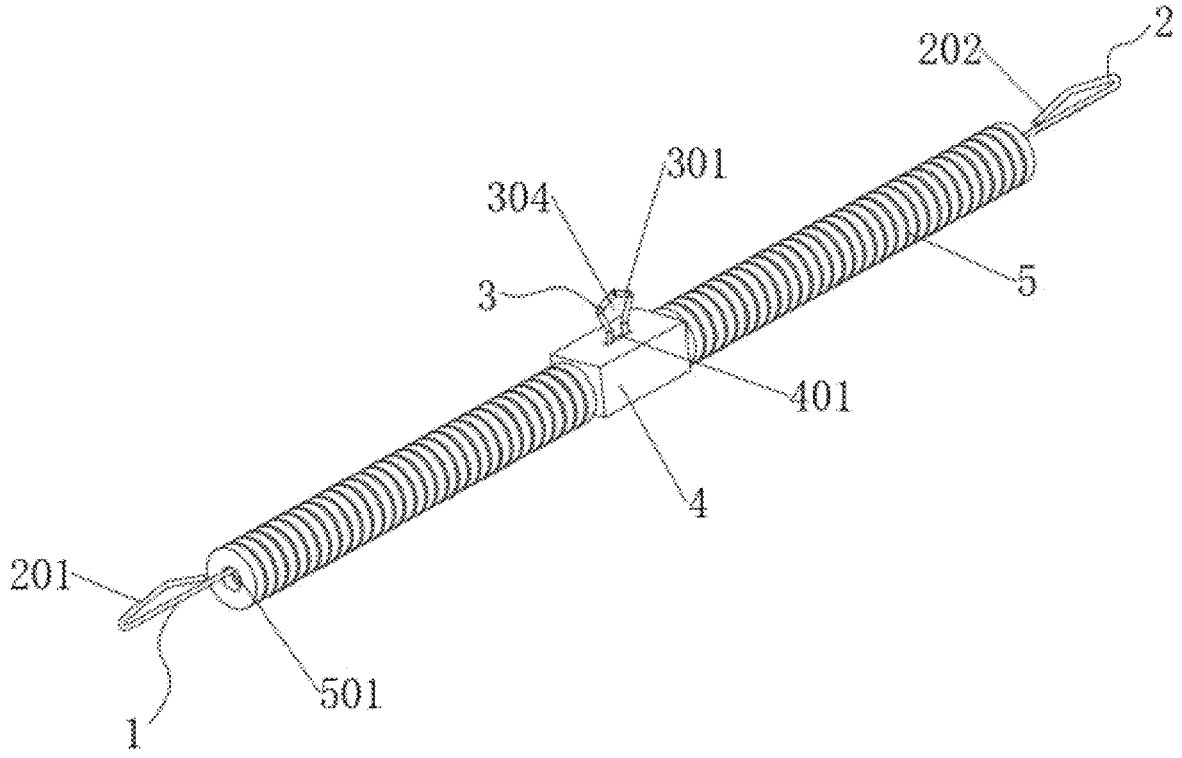
FIG. 1 is a schematic structural view according to Embodiment 1 of the invention.
Figure 2:
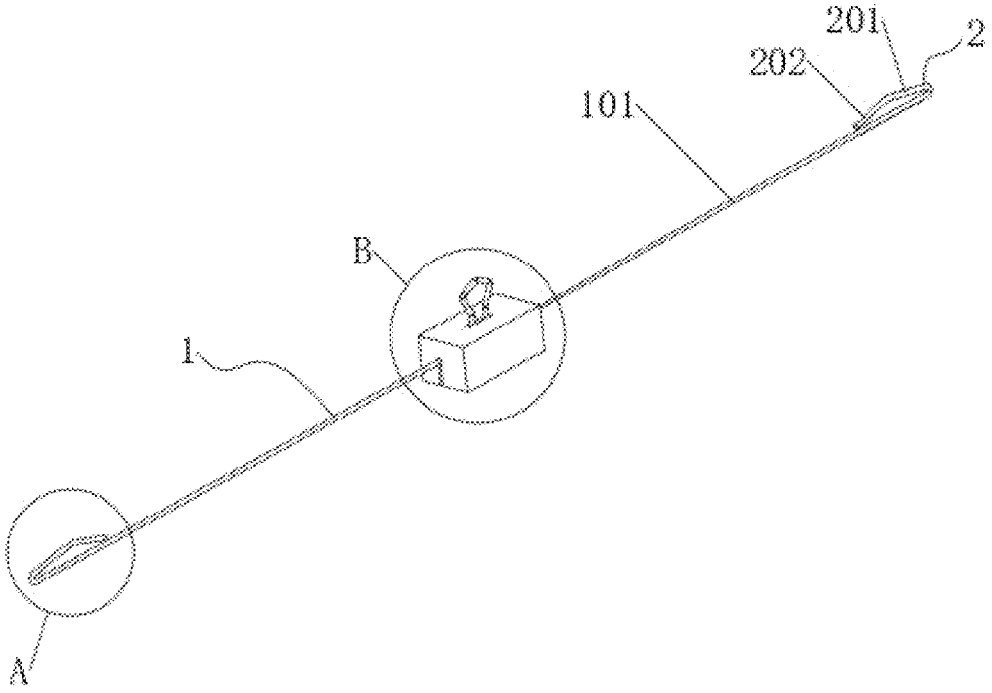
FIG. 2 is a schematic structural view of a long rod according to Embodiment 1 of the invention.
Figure 3:
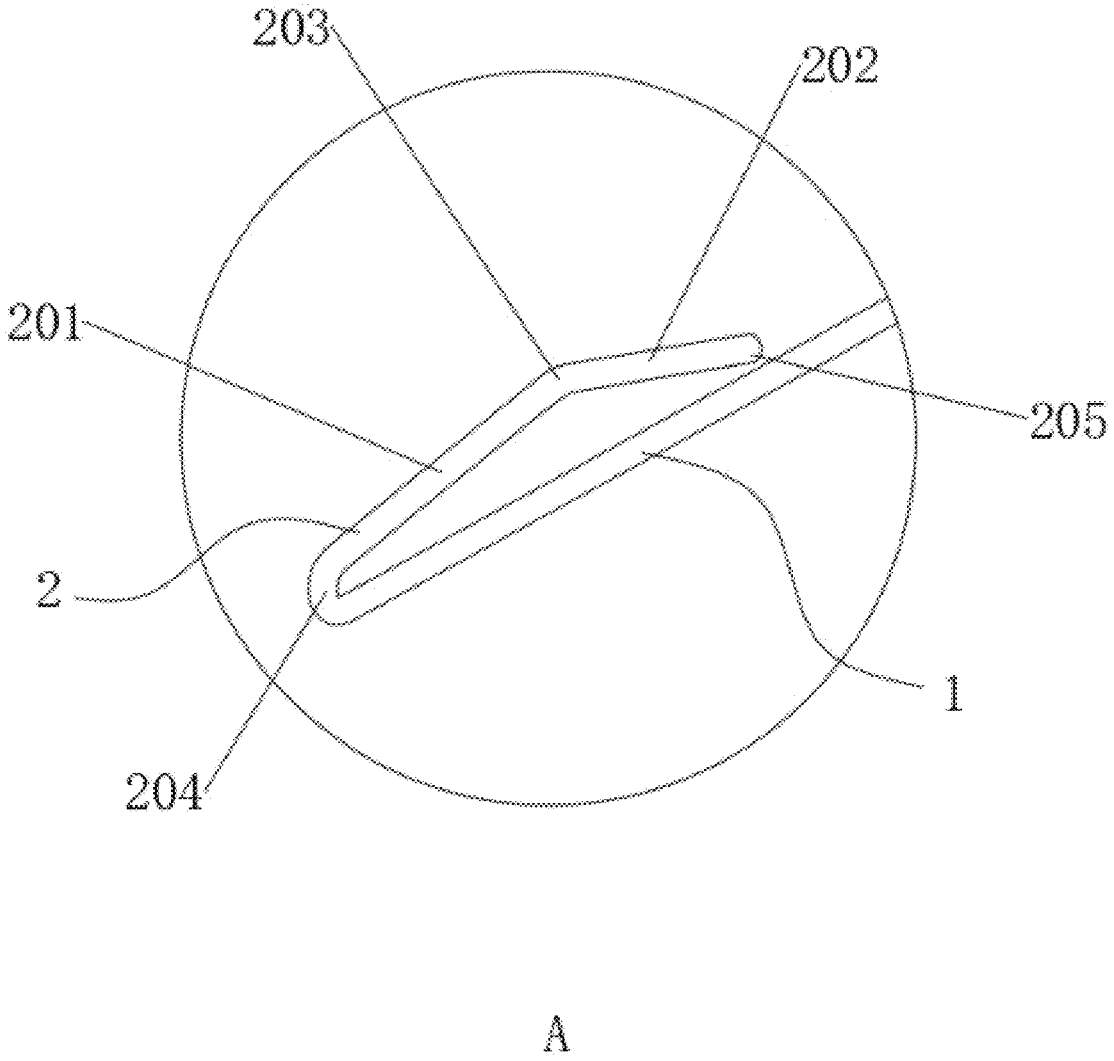
FIG. 3 is a schematic enlarged view of part A in FIG. 2 according to the invention.
Figure 4:
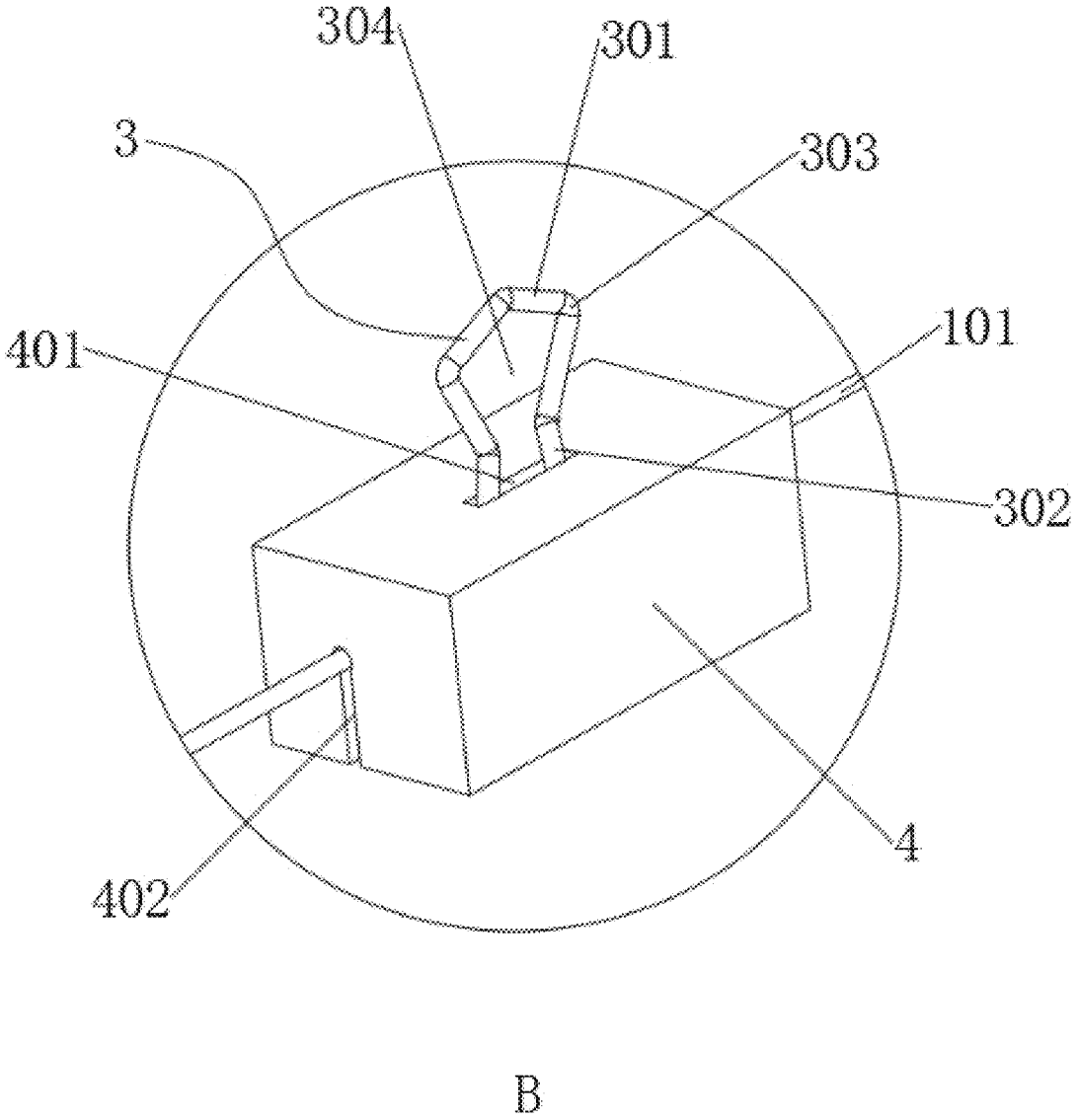
FIG. 4 is a schematic enlarged view of part B in FIG. 2 according to the invention.
Figure 5:
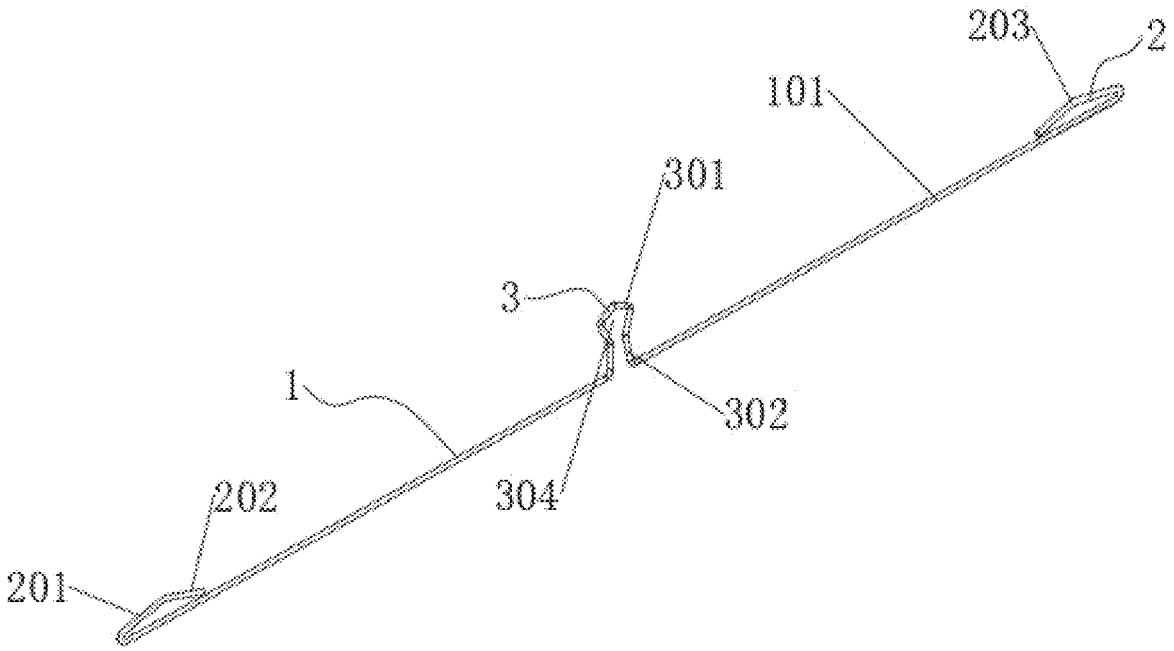
FIG. 5 is a state diagram in absence of a fixed silicone block in FIG. 2 according to the invention.
Figure 6:
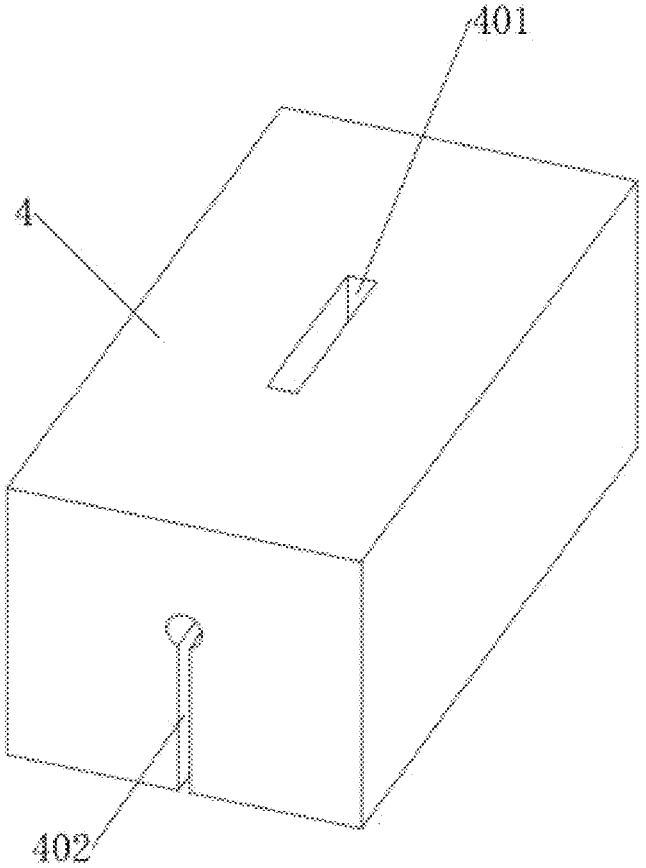
FIG. 6 is a schematic structural view of the fixed silicone block according to the invention.
Figure 7:
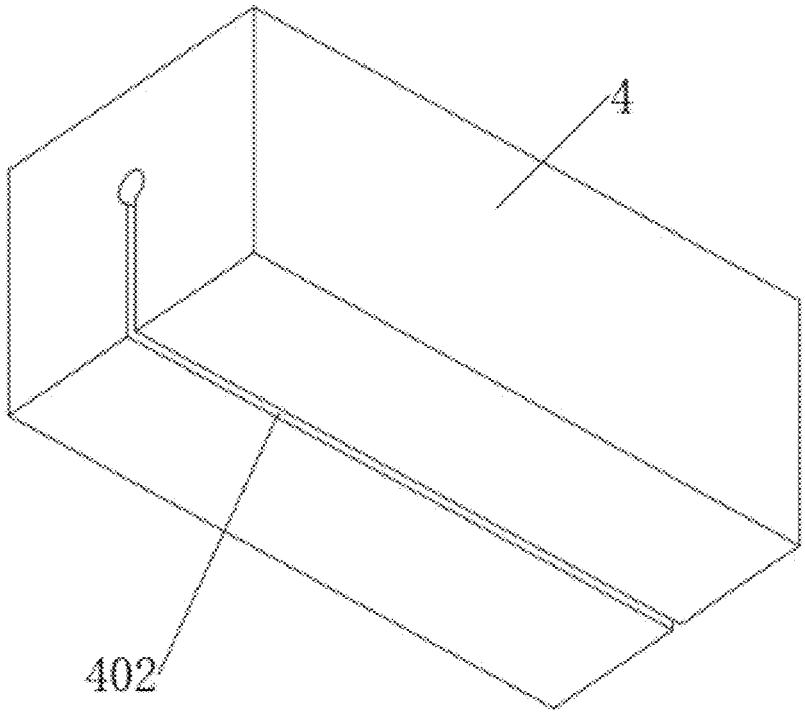
FIG. 7 is a schematic structural view of the fixed silicone block from another perspective according to the invention.
Figure 8:
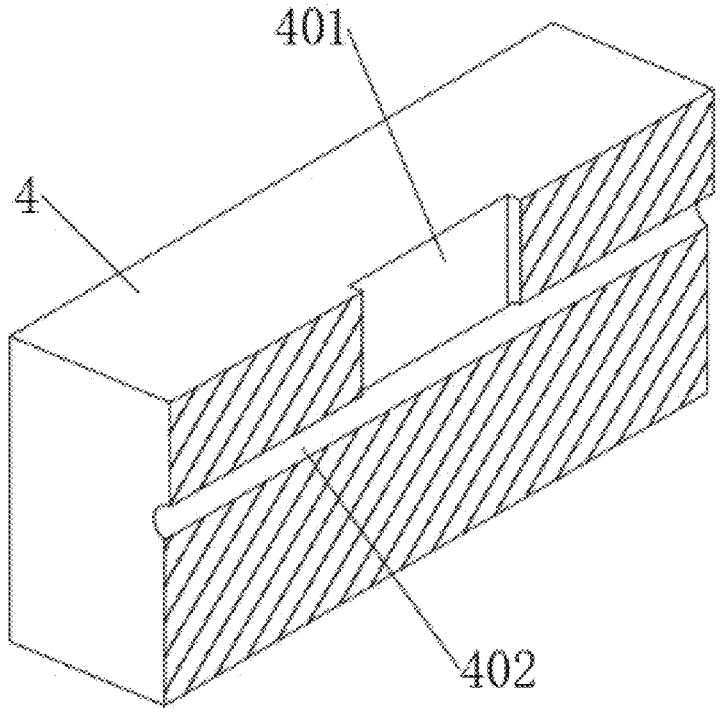
FIG. 8 is a sectional view of the fixed silicone block according to the invention.

In the FIG. (1), long rod; (101), carrying portion; (2), anti-drop end; (201), first bent rod; (202), second bent rod; (203) protruding portion; (204), bent portion; (205), movable end; (206), extension end; (3) grip end; (301), inflexed portion; (302), connecting portion; (303), limit portion; (304), suspension opening; (305), handle; (4), fixed silicone block; (401), aperture; (402), groove; (5), bead; (501), hole; (6), movable silicone block.

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

Embodiment 1

Referring to FIG. 1-FIG. 8, the invention provides a device strung with beads, comprising a long rod 1 and a plurality of beads 5, wherein the long rod 1 comprises an least one anti-drop end 2 and at least one grip end 3, the grip end 3 is integrally formed on the long rod 1, the anti-drop end 2 is located at an end of the long rod 1 and is away from the grip end 3, and a portion, located between the grip end 3 and the anti-drop end 2, the long rod 1 is configured as a carrying portion 101, the beads 5 are strung on the carrying portion 101, a hole 501 is formed in the middle of each of the beads 5, and the long rod 1 penetrates through the holes 501.

The anti-drop end 2 comprises a first bent rod 201 and a second bent rod 202 located on an inner side of the first bent rod 201, the first bent rod 201 and the second bent rod 202 are formed integrally, the first bent rod 201 is integrally formed at the end of the long rod 1 to form a bent portion 204, a joint of the first bent rod 201 and the second bent rod 202 is arched to form a protruding portion 203, an end, close to the carrying portion 101, of the second bent rod 202 is configured as a movable end 205, the long rod 1 is made from an elastic material, and the bent portion 204 and the protruding portion 203 are both elastically deformable.

As described above, the long rod 1 may be made from spring steel, elastic plastic or other elastic materials, and slopes inclining upwards are formed on outer sides of the first bent rod 201 and the second bent rod 202; when the first bent rod 201 or the second bent rod 202 is pressed, the bent portion 204 and the protruding portion 203 will be squeezed to deform elastically; a clearance is reserved between the movable end 205 and the long rod 1 to allow for a movement clearance between the anti-drop end 2 and the long rod when the bent portion 204 or the protruding portion 203 is squeezed.

When the bent portion 204 and the protruding portion 203 are in a normal condition, the vertical distance between the protruding portion 203 and the long rod 1 is greater than the diameter of the holes 501; when the bent portion 204 or the protruding portion 203 is squeezed, the vertical distance between the protruding portion 203 and the long rod 1 is less than the diameter of the holes 501; when the bent portion 204 or the protruding portion 203 is squeezed, the movable end 205 moves downwards along the long rod 1.

When the bead 5 needs to be stung on the long rod 1, the bead 5 is first strung between the long rod 1 and the first bent rod 201 by means of the hole 501 and is then pushed to move towards the carrying portion 101 of the long rod 1, and during the movement process of the bead 5, because the first bent rod 201 inclines upwards, a downward pressure will be generated with the movement of the bead 5 and will squeeze the anti-drop end 2 to move downwards along the long rod 1, the bent portion 204 and the protruding portion 203 will be bent to deform elastically, and at the same time, the angle between the first bent rod 201 and the second bent rod 202 will become larger, such that the distance between the protruding portion 203 and the long rod 1 will become less than the diameter of the hole 501; then, the bead 5 will move continuously to pass through the anti-drop end 2 to be strung on the carrying portion 101, such that the bead 5 is strung on the long rod 1. Multiple beads 5 can be stacked and strung on the long rod 1 one by one in the same way.

When the bead 5 is strung on the carrying portion 101, the external pressure applied to the anti-drop end 2 will disappear, the bent portion 204 and the protruding portion 203 will rebound to drive the anti-drop end 2 to move upwards to return, at the same time, the distance between the protruding portion 203 and the long rod 1 will become greater than the diameter of the hole 501 again, such that the bead 5 will be limited on the long rod 1 without an external pushing force and will not drop from the long rod 1. When the bead 5 needs to be unstrung from the long rod 1, the bead 5 can be pushed towards the outer side of the long rod 1 and then passes through the anti-drop end 2 in the same way to be unstrung from the long rod 1.

When the bead 5 passes through the anti-drop end 2, the protruding portion 203 and the bent portion 204 elastically deform separately, such that when one of the bent portion 204 and the protruding portion 203 can no longer deform elastically due to fatigue or other various reasons, the other one of the bent portion 204 and the protruding portion 203 can deform elastically to allow the bead to smoothly pass through the anti-drop end 2.

Figure 16:
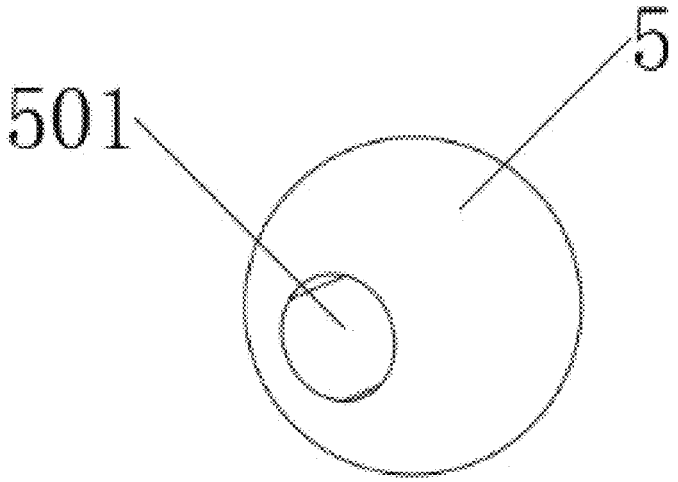
FIG. 16 is a second schematic structural view of the bead according to the invention.
Figure 17:
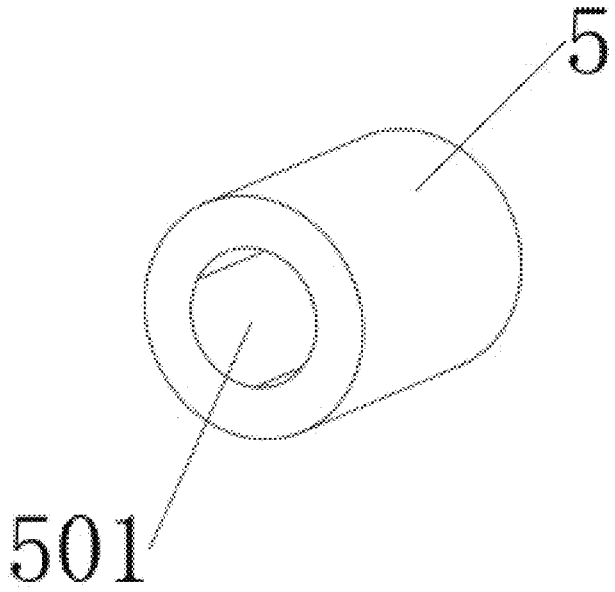
FIG. 17 is a third schematic structural view of the bead according to the invention.

The carrying portion 101 is arranged on the long rod 1, and the beads 5 can be strung on the carrying portion 101; after being strung on the carrying portion 101, the beads 5 will be limited on the long rod 1 by the anti-drop end 2, such that the beads 5 can be stored and carried easily and will not be scattered, and intertwining and knotting of bead strings are avoided; the length of the long rod 1 can be set as actually needed to allow users to carry a desired number of beads 5 according to personal needs; and the beads 5 may be, but not limited to, disc-shaped, and may also be spherical or cylindrical or in other solid geometric shapes, as shown in FIG. 16 and FIG. 17.

Figure 9:
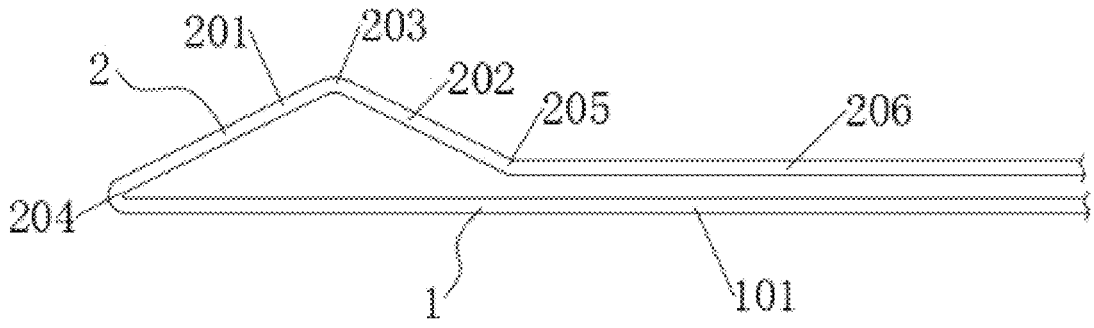
FIG. 9 is a second schematic view of an anti-drop end according to the invention.

Based on the above description, in a second implementation of the anti-drop end 2, as shown in FIG. 9, an extension ends 206 extending towards the grip end 3 is arranged at the movable end 205, and the extension end 206 is parallel to the carrying portion 101. By adopting such a structure, when the bead 5 passes through the movable end 205 to be strung on the carrying portion 101, the extension end 206 will also be located in the hole 501 of the bead 5, that is, the bead 5 is strung on both the carrying portion 101 and the extension end 206. In this way, the extension ends 206 can expand in a direction away from the carrying portion 101 under the clastic action of the bent portion 204 to clamp the bead 5 together with the carrying portion 101, such that the bead 5 strung on the long rod 1 is unlikely to shake in a radial direction.

Figure 10:
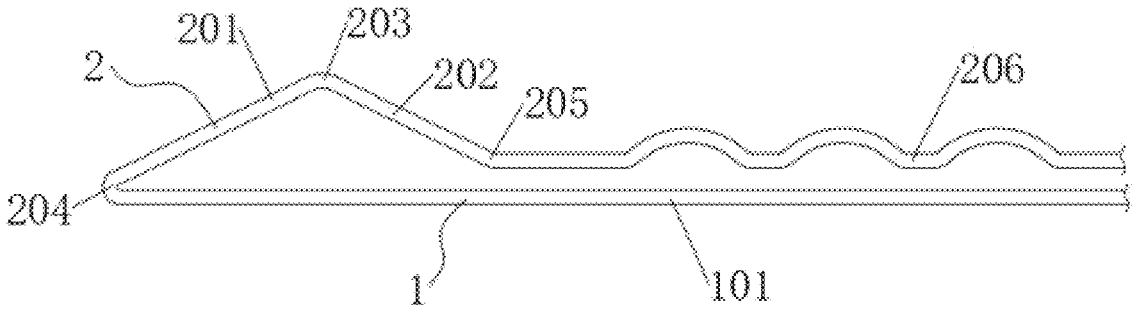
FIG. 10 is a third schematic view of the anti-drop end according to the invention.

In a third implementation of the anti-drop end 2, as shown in FIG. 10, different from the second implementation: a plurality of protrusions is arranged at the extension end 206, and the shape of the protrusions may be, but not limited to, an arc shape, a cone shape, a rectangular shape and other geometric shapes. In this way, when the beads 5 are strung on the carrying portion 101 and the extension end 206, the protrusions can limit the beads 5 in an axial direction to prevent the beads 5 from shaking or moving in an axial direction, thus further improving the stability of the beads 5 during the carrying process.

Figure 11:
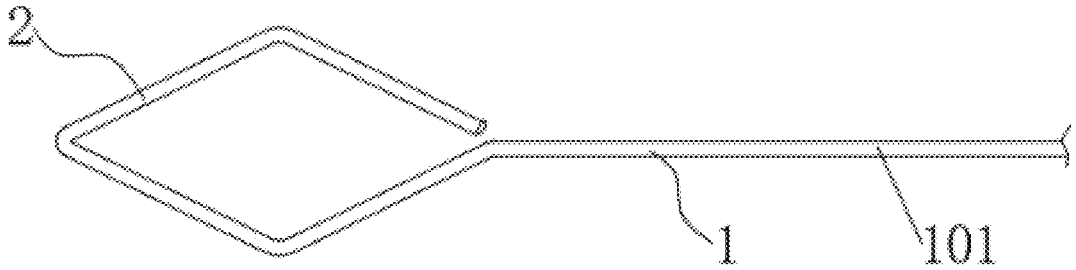
FIG. 11 is a fourth structural view of the anti-drop end according to the invention.

In a fourth implementation of the anti-drop end 2, as shown in FIG. 11, the anti-drop end 2 is in the shape of a symmetrical diamond. By adopting such a structure, beads 5 with large-diameter holes 501 can pass through the anti-drop end 2.

Figure 12:
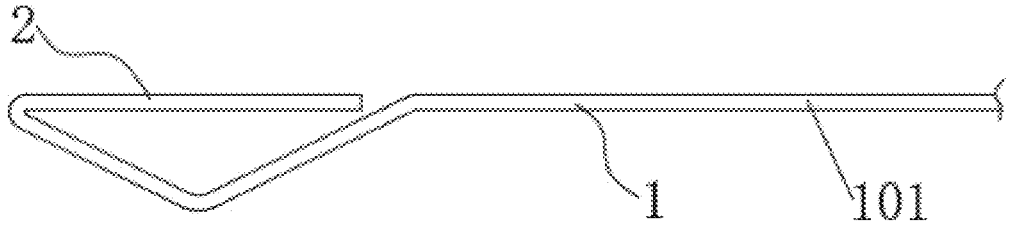
FIG. 12 is a fifth structural view of the anti-drop end according to the invention.

In a fifth implementation of the anti-drop end 2, as shown in FIG. 12, a movable portion of the anti-drop end 2 is straight and located on the same axis as the long rod 1. By adopting such a structure, a smaller elastic counterforce is generated when the beads 5 are strung on the long rod 1, and the beads 5 can be strung on the long rod 1 more easily.

Figure 13:
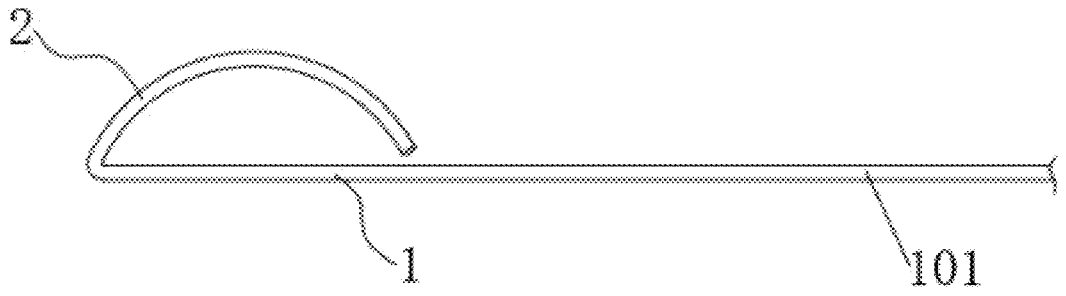
FIG. 13 is a sixth structural view of the anti-drop end according to the invention.

In a sixth implementation of the anti-drop end 2, as shown in FIG. 13, the anti-drop end 2 is semicircular. By adopting such a structure, the anti-drop end 2 can deform elastically within a wider range to allow beads 5 with holes 501 within a wider diameter range to be strung on the long rod 1.

The grip end 3 comprises inflexed portions 301 and connecting portions 302, wherein the connecting portions 302 are integrally formed on the long rod 1, the inflexed portions 301 are located at tops of the connecting portions 302 and integrally formed on the connecting portions 302, two sides of the inflexed portions 301 expand outwards to form the limit portions 303, a hollow structure defined by the inflexed portions 301 is configured as a suspension opening 304, a fixed silicone block 4 for sealing the suspension opening 304 to form a closed structure is disposed around the grip end 3, an aperture 401 is formed in the middle of a top surface of the fixed silicone block 4, the inflexed portions 301 upwards stretch out of the aperture 401, the distance between the limit portions 303 on the two sides of the inflexed portions 301 is greater than the length of the aperture 401, a groove 402 connected to the aperture 401 is formed in the bottom of the fixed silicone block 4, and the middle of the long rod 1 and the connecting portions 302 are all inlaid in the groove 402.

When the bead 5 needs to be strung on or unstrung from the long rod 1, a user grips the fixed silicone block 4 with one hand and pushes the bead 5 to move with the other hand, such that the user can apply force more easily. When the beads 5 strung on the long rod 1 need to be carried or transported, the user can hold the fixed silicone block 4 with fingers to carry the beads 5 conveniently; the fixed silicone block 4 can seal the suspension opening 304 to form the closed structure, and when the beads 5 are carried or transported, a string can penetrate through the suspension opening 304 to tie the device strung with the beads 5 at a desired position, or the suspension opening 304 can be hung on a hook, such that the beads 5 can be transported or carried more conveniently; in addition, when the beads 5 are transported or carried, a slot corresponding to the anti-drop end 2 can be formed in a transport device, and the anti-drop end 2 can be clamped in the slot to be fixed.

The fixed silicone block 4 is cuboid-shaped or in other solid geometric shapes allowing the fixed silicone block 4 to be held and gripped easily; the fixed silicone block 4 is made from silicon or other elastic materials, such that the aperture 401 can deform to change its size to fit the limit portions 303. When the inflexed portions 301 penetrate through the aperture 401, the limit portions 303 can expand the aperture 401 and penetrate through the aperture 401; after the inflexed portions 301 penetrate through the aperture 401, the aperture 401 contracts to restore. In this way, the fixed silicone block 4 can be easily and quickly assembled on the long rod 1 and is unlikely to be detached from the long rod 1. The aperture 401 defined by the two inflexed portions 301 is not limited to the shape shown in the FIGS., and may also be mushroom-shaped, rectangular or in other geometric shapes facilitating gripping or allowing a string to penetrate through.

Embodiment 2

Figure 14:
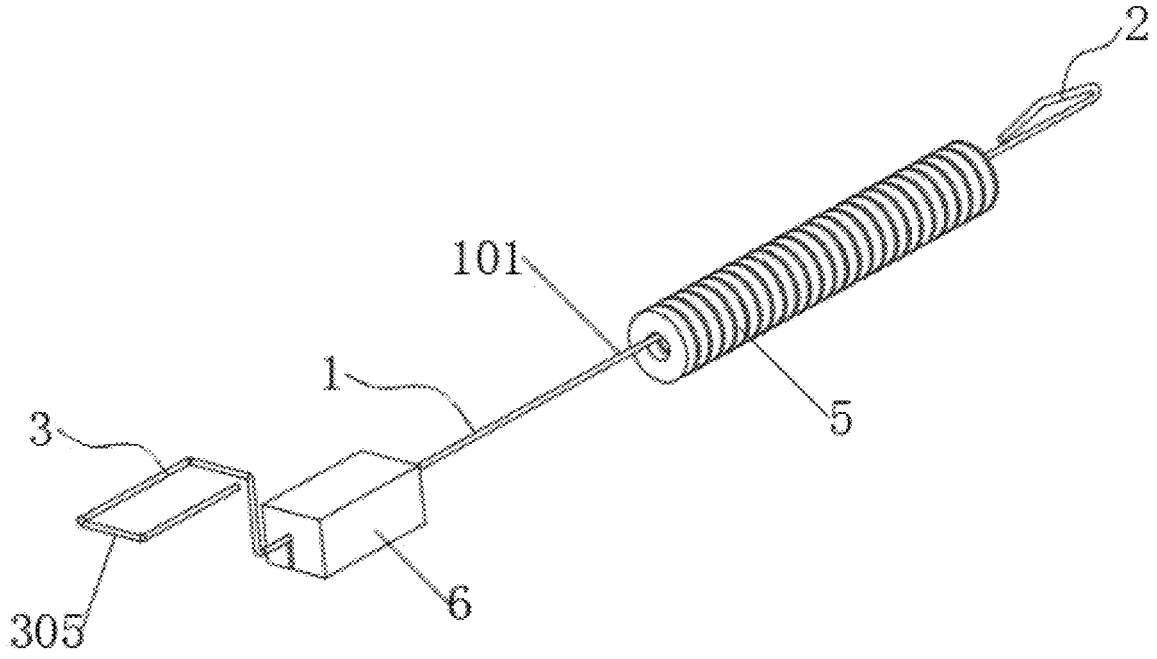
FIG. 14 is a schematic structural view according to Embodiment 2 of the invention.
Figure 15:
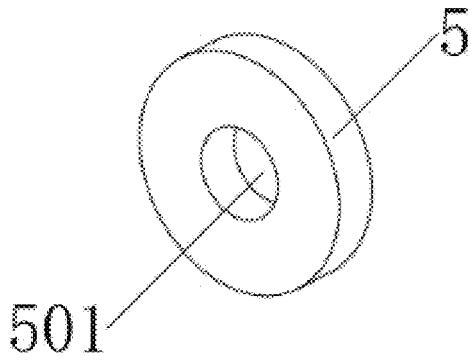
FIG. 15 is a schematic structural view of a bead according to the invention.

Referring to FIG. 14, this embodiment is the same as Embodiment 1 in the anti-drop end 2 and is different from Embodiment 1 in the following aspects: the grip end 3 comprises a handle 305 which is integrally formed at an end of the long rod 1, and a movable silicone block 6 is disposed around the carrying portion 101 and located between the handle 305 and the beads 5.

The handle 305 is rectangular or in other geometric shapes allowing the handle 305 to be gripped easily; and the handle 305 is a hollow structure, and users can grip the handle 305 with fingers to string the beads 5. When the beads 5 are carried or transported, a hook or a string can penetrate through the hollow structure of the handle 305 to hang the long rod 1 during the transporting process, and the anti-drop end 2 can be clamped in a corresponding slot formed in a transportation device to be fixed during the carrying or transporting process.

The movable silicone block 6 is made from silicon or other elastic materials, and is cuboid-shaped or in other solid geometric shapes allowing the movable silicone block 6 to be held and gripped easily; the movable silicone block 6 is able to slide along the carrying portion 101; when the beads 5 need to be unstrung from the carrying portion 101, users can grip the movable silicone block 6 to slide the movable silicone block 6 towards the anti-drop end 2, and all the beads 5 are pushed by the movable silicone block 6 to synchronously slide towards and then penetrate through the anti-drop end 2. In this way, all the beads 5 can be quickly pushed down from the long rod 1, and the beads 5 can be unstrung more easily and quickly.

When the beads are stung, the movable silicone block 6 can be gripped and slid towards the carrying portion 101 to be adjusted to a desired position; and In this way, during the bead stringing process, the distance between the grip portion and the anti-drop end can be decreased to allow the beads 5 to be strung more easily and quickly.

To Sum Up:

The carrying portion 101 is arranged on the long rod 1, the beads 5 can be strung on the carrying portion 101; after being strung on the carrying portion 5, the beads 5 will be limited on the long rod 1 by the anti-drop end 2, such that the beads 5 can be stored and carried easily and can be prevented from being scattered; the collected beads 5 can be gripped and carried easily and quickly by means of the grip end 3; the suspension opening 304 is arranged, and when the beads 5 are transported or carried, a string can penetrate through the suspension opening 304 to tie the device strung with the beads 5 at a desired position, or the suspension opening 304 can be hung on a hook, such that the beads 5 can be transported or carried more easily; and the anti-drop end 2 can prevent the beads 5 from dropping from the long rod 1.

The invention further provides a carrying method for beads. The method uses a device strung with beads, the device comprises a long rod 1 and at least one bead 5, the long rod 1 comprises at least one anti-drop end 2 and at least one grip end 3, the grip end 3 is integrally formed on the long rod 1, the anti-drop end 2 is located at an end of the long rod 1, and a portion, between the grip end 3 and the anti-drop end 2, of the long rod 1 is configured as a carrying portion 101;

the method comprises the following steps:

Step 1, a hole 501 of the bead 5 is aligned with the anti-drop end 2 of the long rod 1, and a fixed silicone block 4, a handle 305 or a movable silicone block 6 is gripped with fingers to apply force to string the bead 5; and Step 2, the bead 5 is first strung between the long rod 1 and a first bent rod 201 and then pushed to slide towards the grip end 3, and when the bead 5 slides along the anti-drop end 2, a bent portion 204 and a protruding portion 203 are squeezed to deform elastically to make the vertical distance between the protruding portion 203 and the long rod 1 less than the diameter of the hole 501;

Step 3, the bead 5 is slid through the anti-drop end 2 and strung on the carrying portion 101, at this moment, the bent portion 204 and the protruding portion 203 rebound to restore, and the vertical distance between the protruding portion 203 and the long rod 1 becomes greater than the diameter of the hole 501, such that the bead 5 is limited by the anti-drop end 2 to be prevented from dropping from the long rod 1;

Step 4, multiple beads 5 are stacked and strung on the carrying portion 101 of the long rod 1 one by one in the same way; and Step 5, when the beads 5 need to be transported or carried, the fixed silicone block 4 is held to transport or carry the beads 5, or the device strung with the beads 5 is hung or clamped at a desired position to transport or carry the beads 5, wherein when the beads 5 are transported or carried, the device is tied at the desired position by means of a string penetrating through a suspension opening 304, or the suspension opening 304 is hung on a hook; or, when the beads 5 are transported or carried, a slot corresponding to the anti-drop end 2 is formed in a transport device, and the anti-drop end 2 is clamped in the slot; and Step 6, when the beads 5 need to be unstrung, the beads 5 are gripped and pushed to move towards the anti-drop end 2 and then slide out of the anti-drop end 2 to be unstrung from the long rod 1.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

What is claimed is:

1. A device strung with beads, comprising a long rod and a plurality of beads, wherein:

the long rod comprises at least one anti-drop end and at least one grip end, the grip end is integrally formed on the long rod, and the anti-drop end is located at an end of the long rod and is away from the grip end; and a portion, located between the grip end and the anti-drop end, of the long rod is configured as a carrying portion, wherein the beads are strung on the carrying portion, a hole is formed in a middle of each of the beads, and the long rod penetrates through the hole;

wherein the anti-drop end comprises a first bent rod and a second bent rod, the second bent rod located on an inner side of the first bent rod, and the first bent rod and the second bent rod are formed integrally; and wherein a joint of the first bent rod and the second bent rod is arched to form a protruding portion, and an end, close to the carrying portion, of the second bent rod is configured as a movable end.

2. The device strung with beads according to claim 1, wherein the first bent rod is integrally formed at the end of the long rod to form a bent portion.

3. The device strung with beads according to claim 2, wherein an extension end extending towards the grip end is arranged at the movable end, and the extension end is parallel to the carrying portion.

4. The device strung with beads according to claim 2, wherein the long rod is made from an elastic material, and the bent portion and the protruding portion are elastically deformable.

5. The device strung with beads according to claim 4, wherein when the bent portion and the protruding portion are in a normal condition, a vertical distance between the protruding portion and the long rod is greater than a diameter of the hole.

6. The device strung with beads according to claim 4, wherein when the bent portion or the protruding portion is squeezed, a vertical distance between the protruding portion and the long rod is less than a diameter of the hole.

7. The device strung with beads according to claim 4, wherein when the bent portion or the protruding portion is squeezed, the movable end moves downwards along the long rod.

8. The device strung with beads according to claim 1, wherein the grip end comprises a handle which is integrally formed at an end of the long rod, and a movable silicone block is disposed around the carrying portion and located between the handle and the beads.

9. A device strung with beads, comprising a long rod and a plurality of beads, wherein:

the long rod comprises at least one anti-drop end and at least one grip end, the grip end is integrally formed on the long rod, and the anti-drop end is located at an end of the long rod and is away from the grip end; and a portion, located between the grip end and the anti-drop end, of the long rod is configured as a carrying portion, wherein the beads are strung on the carrying portion, a hole is formed in a middle of each of the beads, and the long rod penetrates through the hole;

wherein the grip end comprises inflexed portions and connecting portions, the connecting portions are integrally formed on the long rod, and the inflexed portions are located at tops of the connecting portions and integrally formed on the connecting portions.

10. The device strung with beads according to claim 9, wherein two sides of the inflexed portions expand outwards to form limit portions, and a hollow structure defined by the inflexed portions is configured as a suspension opening.

11. The device strung with beads according to claim 10, wherein a fixed silicone block for sealing the suspension opening to form a closed structure is disposed around the grip end, an aperture is formed in a middle of a top surface of the fixed silicone block, the inflexed portions are a distance away from the aperture, and a distance between the limit portions on the two sides of the inflexed portions is greater than a length of the aperture.

12. The device strung with beads according to claim 11, wherein a groove connected to the aperture is formed in a bottom of the fixed silicone block, and a middle of the long rod and the connecting portions are all inlaid in the groove.

13. A carrying method for beads, using a device strung with beads, the device comprising a long rod and at least one bead, the long rod comprising at least one anti-drop end and at least one grip end, the grip end being integrally formed on the long rod, the anti-drop end being located at an end of the long rod, a portion, between the grip end and the anti-drop end, of the long rod being configured as a carrying portion; and the method comprising:

Step 1, aligning a hole of the bead with the anti-drop end of the long rod; and

Step 2, stringing the bead between the long rod and a first bent rod, and then pushing the bead to slide toward the grip end; and Step 3, sliding the bead through the anti-drop end and stringing the bead on the carrying portion; and Step 4, stacking and stringing multiple beads on the carrying portion of the long rod according to Step 1 to Step 3;

Step 5, when the beads need to be transported or carried, transporting or carrying the beads by holding a fixed silicone block, or by hanging or clamping the device strung with the beads at a desired position; and Step 6, when the beads need to be unstrung, gripping the beads and pushing the beads to move towards the anti-drop end and then slide out of the anti-drop end to be unstrung from the long rod.

14. The carrying method for beads according to claim 13, wherein when the bead is strung, the fixed silicone block, a movable silicone block or a handle is gripped with fingers to apply force to string the bead on the long rod.

15. The carrying method for beads according to claim 13, wherein when the bead is slid along the anti-drop end, a bent portion and a protruding portion are squeezed to deform elastically, and a vertical distance between the protruding portion and the long rod is less than a diameter of the hole.

16. The carrying method for beads according to claim 15, wherein after the bead is strung on the carrying portion, the elastic deformation of the bent portion and the protruding portion is undone by releasing the squeeze, the vertical distance between the protruding portion and the long rod is greater than the diameter of the hole, and the bead is limited by the anti-drop end to be prevented from falling down from the long rod.

17. The carrying method for beads according to claim 13, wherein when the beads are transported or carried, the device is tied at the desired position by a string penetrating through a suspension opening, or the suspension opening is hung on a hook.

18. The carrying method for beads according to claim 13, wherein when the beads are transported or carried, a slot corresponding to the anti-drop end is formed in a transport device, and the anti-drop end is clamped in the slot to be fixed.

* * * * *